US008109745B2

(12) United States Patent
Wu

(10) Patent No.: US 8,109,745 B2
(45) Date of Patent: Feb. 7, 2012

(54) FLOOR PUMP

(76) Inventor: Scott Wu, Taichung Hsien (TW)

( * ) Notice: Subject to any disclaimer, the term of this patent is extended or adjusted under 35 U.S.C. 154(b) by 476 days.

(21) Appl. No.: 12/356,580

(22) Filed: Jan. 21, 2009

(65) Prior Publication Data

US 2010/0180957 A1 Jul. 22, 2010

(51) Int. Cl.
*F04B 53/12* (2006.01)

(52) U.S. Cl. ..... 417/550; 417/234; 417/555.1; 417/467; 417/547

(58) Field of Classification Search ..... 417/63, 417/455, 467, 528, 547, 550
See application file for complete search history.

(56) References Cited

U.S. PATENT DOCUMENTS

| | | | | |
|---|---|---|---|---|
| 3,890,684 | A * | 6/1975 | Tallman | 29/888.02 |
| 5,779,457 | A * | 7/1998 | Chuang et al. | 417/467 |
| 6,116,873 | A * | 9/2000 | Wang | 417/550 |
| 6,250,205 | B1 * | 6/2001 | Chuang | 92/15 |
| 6,325,601 | B2 * | 12/2001 | Wu | 417/469 |
| 6,602,061 | B2 * | 8/2003 | Chuang | 417/572 |
| 6,652,242 | B2 * | 11/2003 | Wu | 417/63 |
| 6,893,232 | B2 * | 5/2005 | Wu | 417/547 |
| 7,331,768 | B2 * | 2/2008 | Wu | 417/63 |
| 2003/0156960 | A1 * | 8/2003 | Wang | 417/528 |
| 2008/0181799 | A1 * | 7/2008 | Wu | 417/455 |

FOREIGN PATENT DOCUMENTS

| | | |
|---|---|---|
| TW | M260634 | 4/2005 |
| TW | M278776 | 10/2005 |

* cited by examiner

*Primary Examiner* — Nimeshkumar Patel
*Assistant Examiner* — Mary Ellen Bowman
(74) *Attorney, Agent, or Firm* — Alan Kamrath; Kamrath IP Lawfirm, PA

(57) ABSTRACT

A floor pump includes a base; and a cylinder assembly having a first end coupled to the base and a second end, with a cross-sectional area of the first end of the cylinder assembly being larger than the second end of the cylinder assembly. A linkage assembly is partially disposed in the cylinder assembly and communicates with the base. A hose has a first end coupled to the base and communicating with the linkage assembly and a second end coupled to a thing desired to be inflated.

9 Claims, 4 Drawing Sheets

FLOOR PUMP

BACKGROUND OF THE INVENTION

1. Field of the Invention

The present invention relates generally to floor pumps and, more particularly, to a floor pump with a stable base.

2. Description of the Related Art

There are two categories of floor pumps: one floor pump is with a collapsible tripod attached on a base member, and the other floor pump is with an enlarged base member which is adapted for standing on the ground to be stepped on by users.

Referring to Taiwan Patent No M278776, a floor pump includes a cylinder 11, a piston linkage 12, a channel 13 and a joint 14. An end of the cylinder 11 is closed and stands on the ground. A tripod 15 is attached to the end of the cylinder 11 and formed by a bent metal. In an operative position of the pump, the tripod 15 is expanded to abut against the ground. The tripod 15 is folded to attach to the cylinder 11 while the pump is in a storage position. The tripod 15 is able to pivot with respect to the cylinder 11 so that the pump is easy for switching between the storage position and the operative position. However, while pumping, the tripod 15 can not provide a stable support, because the cylinder 11 might swing with respect to the tripod 15.

Referring to Taiwan Patent No M260634, another floor pump includes a base member 11, a cylinder 12, a hose 13 and a piston linkage 14. The cylinder 12 and the hose 13 are coupled to the base member 11. However, an abrasion phenomenon of a connector between the base member 11 and the cylinder 12 is going to occur when the piston linkage 14 is moved in the cylinder 12 up and down over a long period of time. In operation, users step on the base member 11 and operate the piston linkage 14 to pump air into the pump upward and to pump air out of the pump downward. As the piston linkage 14 is moved upward, a piston connected to the piston linkage 14 rubs against the cylinder 12 to provide an upward force to the cylinder 12, while users standing on the base member 11 provides a downward force to the base member 11. Therefore, the connector between the base member 11 and the cylinder 12 bears the upward force and the downward force at the same time. The larger the strength users put forth, the larger torque the connector bears. It might cause the cylinder 12 to break easily. In addition, the cylinder 12 is straight, so that the structure strength of the connector is weakened.

The present invention is therefore intended to obviate or at least alleviate the problems encountered in the prior art.

SUMMARY OF THE INVENTION

Accordingly, the object is achieved by providing a floor pump that comprises a base, a cylinder assembly, a linkage assembly and a hose. The cylinder assembly includes a straight inner cylinder and a tapered outer cylinder. A first end of the outer cylinder, which is coupled to the base, has a larger cross-sectional area than a second end of the outer cylinder.

Because the first end of the outer cylinder has the larger cross-sectional area than the other portions of the outer cylinder, the pressure of the first end of the outer cylinder has to bear is smaller than the other portions of the outer cylinder. Therefore, the structure of the first end of the outer cylinder is much stronger.

Other advantages and features of the present invention will become apparent from the following descriptions referring to the drawings.

BRIEF DESCRIPTION OF THE DRAWINGS

The present invention will be described via detailed illustration of the preferred embodiment referring to the drawings.

DETAILED DESCRIPTION OF THE PREFERRED EMBODIMENTS

Figure 1:
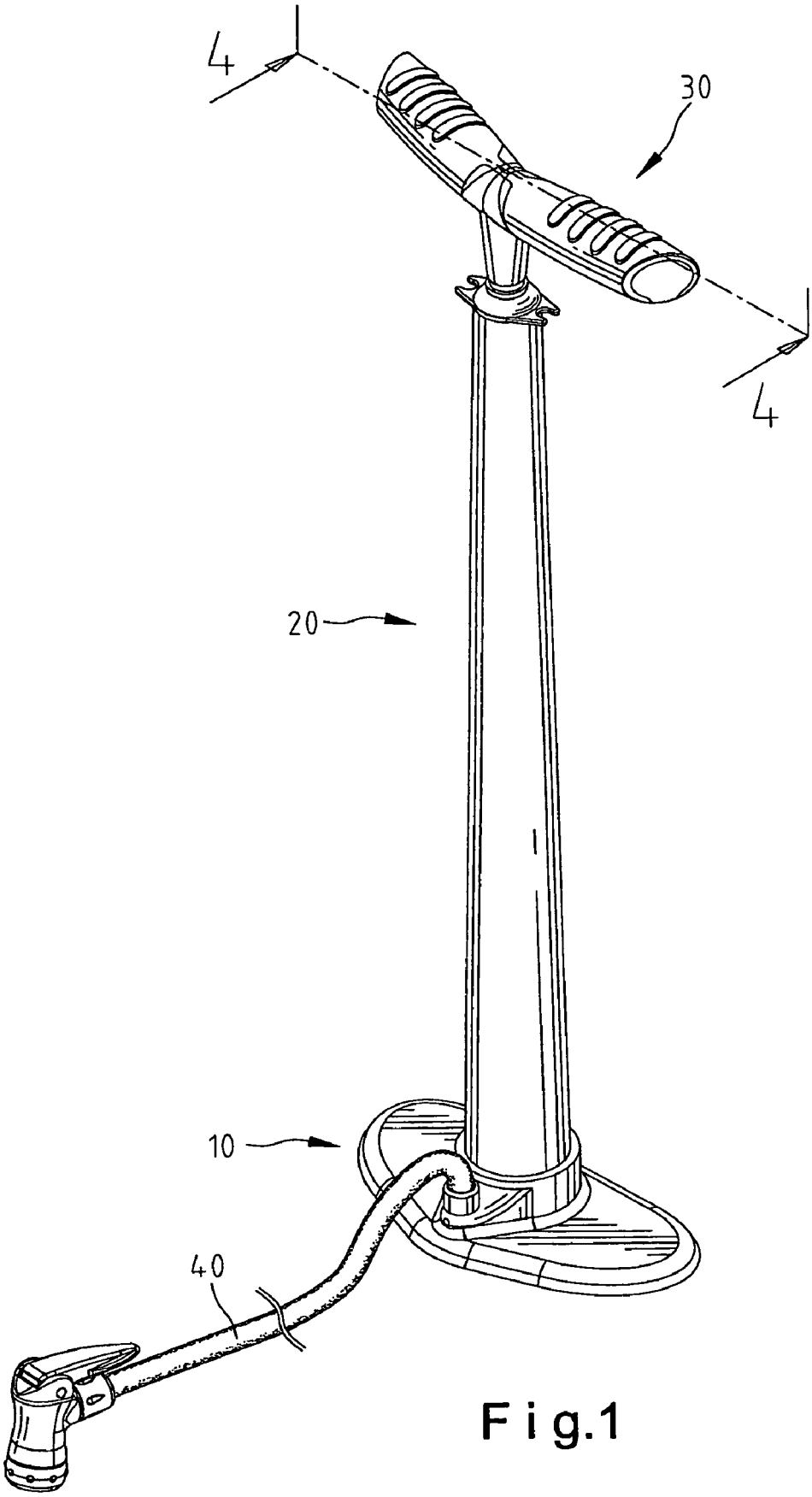
FIG. 1 is a perspective view of a floor pump according to the preferred embodiment of the present invention.
Figure 2:
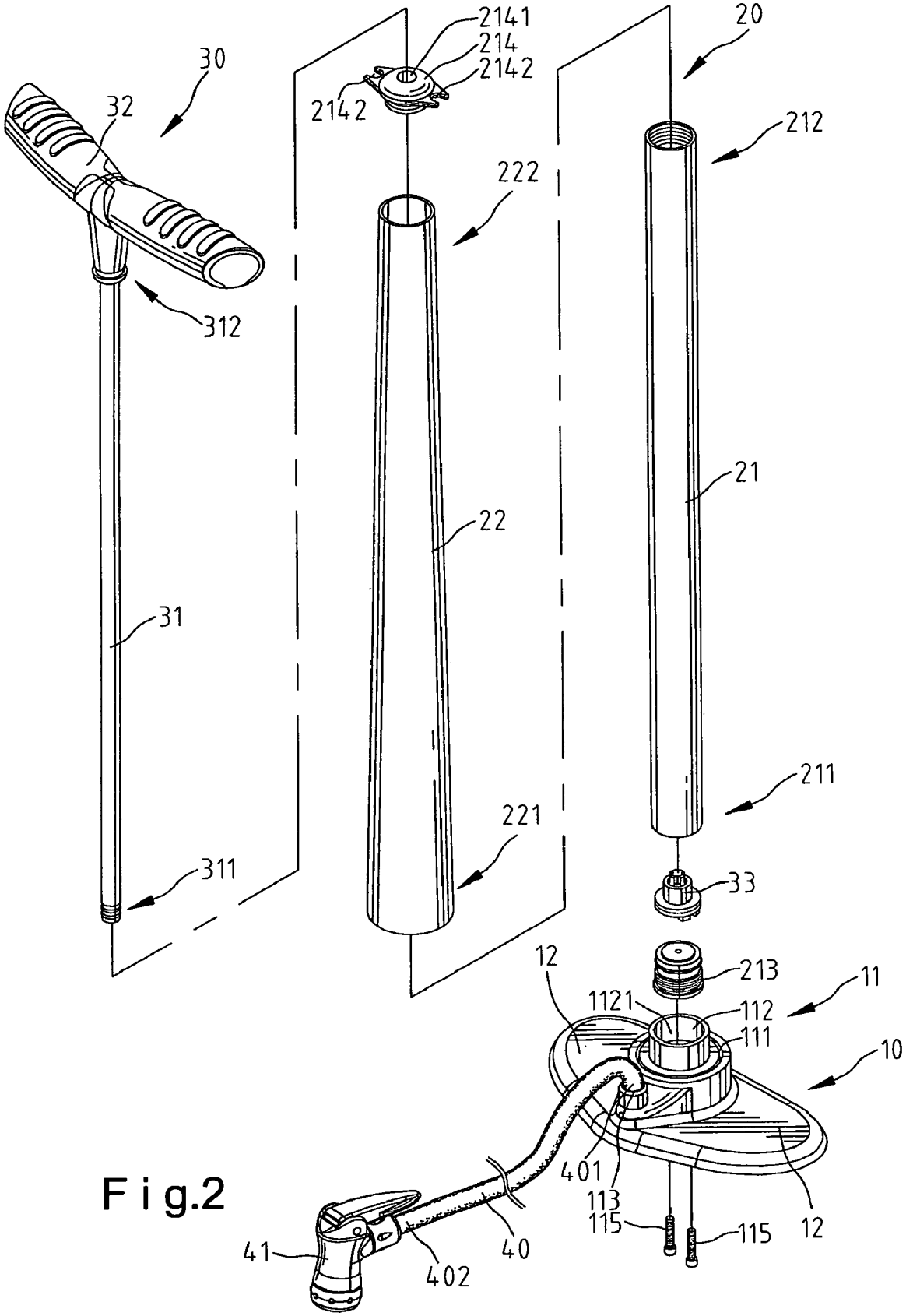
FIG. 2 is an exploded view of the floor pump shown in FIG. 1.
Figure 3:
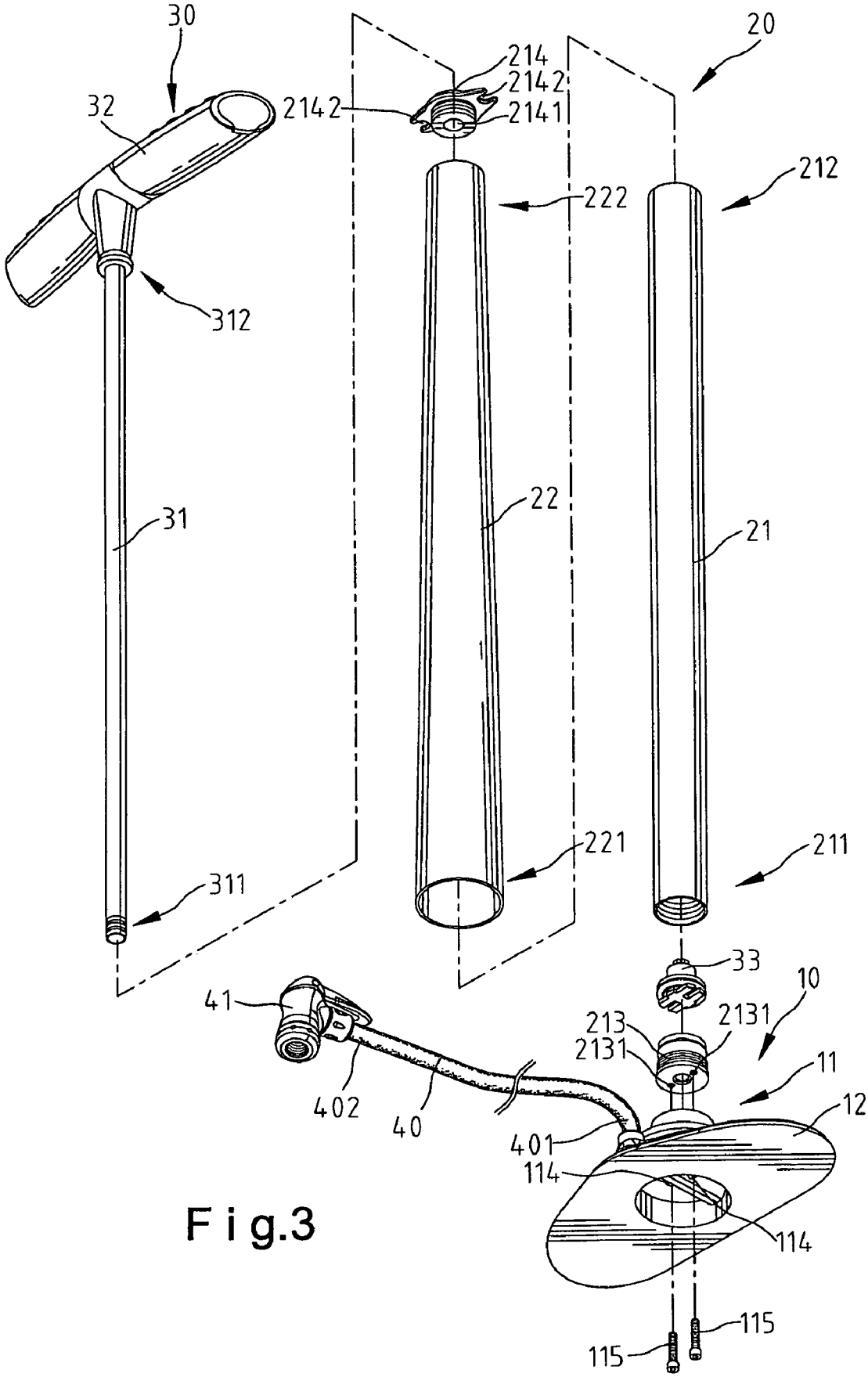
FIG. 3 is another exploded view of the floor pump similar to FIG. 2.
Figure 4:
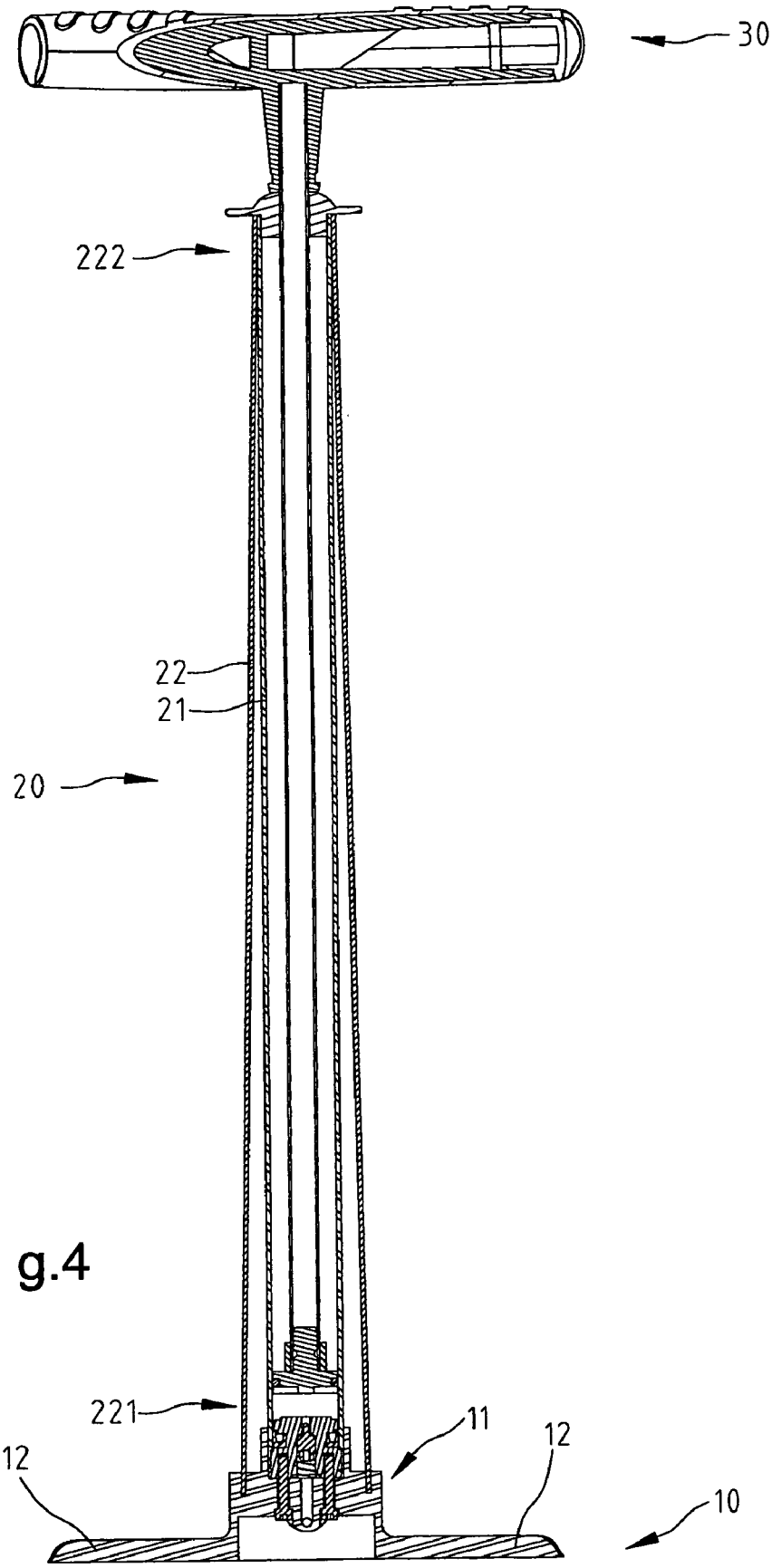
FIG. 4 is a cross-section view of the floor pump according to line 4-4 shown in FIG. 1.

Referring to FIGS. 1 through 4, a floor pump includes a base 10, a cylinder assembly 20 installed onto the base 10, a linkage assembly 30 disposed in and reciprocatingly moving with respect to the cylinder assembly 20 for inflating, and a hose 40. The hose 40 includes a first end 401 coupled to the base 10 and a second end 402 coupled to a thing desired to be inflated.

The base 10 includes a coupled member 11 and a pedal member 12. The coupled member 11 integrally protrudes from the pedal member 12, and the pedal member 12 expands from two sides of the coupled member 11. The coupled member 11 includes a first connective portion 111 coupled on the pedal member 12, a second connective portion 112 surrounded by the first connective portion 111 and a third connective portion 113 adapted to couple to the hose 40. The first connective portion 111 is in a form of an annular groove, and horizontal positions of the first and second connective portions 111, 112 are different. The coupled member 11 has a first side and a second side against the hose. The first and second connective portions 111, 112 are defined at the first side, and the third connective portion 113 is defined at the second side of the coupled member 11. A receptacle 1121 is formed on the second connective portion 112. A direction of the receptacle 1121 is the same as that of the cylinder assembly 20. Two engaged holes 114 are longitudinally defined at the coupled member 11 and communicates the first and second connective portions 111, 112 with each other.

The cylinder assembly 20 includes a straight inner cylinder 21 having a first end 211 and a second end 212 and an outer cylinder 22 having a first end 221 and a second end 222. The inner cylinder 21 is disposed in the outer cylinder 22. In this embodiment, the inner and outer cylinders 21, 22 are made of aluminum. A diameter of the first end 211 of the inner cylinder 21 is equal to the second end 212 of the inner cylinder 21. A valve element 213, which is engaged with the first end 211 of the inner cylinder 21 in a screw manner and disposed in the receptacle 1121, has two fixed holes 2131, which are formed on the bottom thereof and correspond to the engaged holes 114. The first end 211 of the inner cylinder 21 is inserted in the second connective portion 112. Two fasteners 115 are adapted to insert through the engaged holes 114 to engage with the fixed holes 2131 as to attach the inner cylinder 21 to the base 10.

A cap element 214, which is mounted on the second end 222 of the outer cylinder 22 and coupled to the second end 212 of the inner cylinder 21 in a screw manner, includes a through-hole 2141 piercing therethrough longitudinally and two hook portions 2142 extending from two sides thereof. The hook portions 2142 are opposite to each other and used for clamping the hose 40 in position selectively.

The outer cylinder 22 is with a constant wall thickness, and a cross-sectional area of the first end 221 of the outer cylinder 22 is smaller than that of the second end 222 of the outer cylinder 22. The first end 221 of the outer cylinder 22 is inserted in the first connective portion 111, and the outer cylinder 22 is coupled to the base 10 inseparatably. The second end 222 of the outer cylinder 22 is positioned out of the second end 212 of the inner cylinder 21.

The linkage assembly 30 includes a linkage 31 that has a first end 311 and a second end 312, a handle 32 installed on the second end 312 and a piston 33 coupled to the first end 311. The linkage 31 is inserted through the inner cylinder 21 to the through-hole 2141 of the cap element 214, and the piston 33 is driven to reciprocatingly move in the inner cylinder 21 by operation of the handle 32. The handle 32 is exposed from the cap element 214.

The hose 40 has a first end 401, which is coupled to the third connective portion 113 of the base 10 and communicates with the cylinder assembly 20, and a second end 402. A joint 41 is attached to the second end 402 of the hose 40 and adapted for connecting to the thing desired to be inflated. During inflating, the handle 32 of the linkage assembly 30 is held to drive the linkage 31 to reciprocatingly move with respect of the inner cylinder 21. An amount of air is inflated into the pump between the piston 33 of the linkage assembly 30 and the inner cylinder 21. Then, air is inflated into the hose 40, the joint 41 and finally the thing desired to be inflated.

In addition, a pressure gauge (not shown) can be installed on the second end 222 of the outer cylinder 22. The first end 401 of the hose 40 communicates with the pressure gauge. Therefore, the first end 401 of the hose 40 communicates with the second end 222 of the outer cylinder 22.

The outer cylinder 22 tapers off to the second end 222 from the first end 221, so that the outer cylinder 22 is shaped as an awl. The cross-sectional area of the first end 221 of the outer cylinder 22 is larger than that of the second end 222 of the outer cylinder 22. Therefore, the outer cylinder 22 can be stably disposed at the base 10. An area of the pedal member 12 is much larger than that of the coupled member 11 so that the floor pump can stably stand on the ground.

In addition, the cylinder assembly 20 consists of the aluminum inner and outer cylinders 21, 22 so that it can save more material cost and so that weight of the pump can also be reduced more than a conventional floor pump which includes one-piece cylinder.

The following discussion shows that the larger area of the base 10 of the floor pump in contact with the ground, the larger force the cylinder assembly 20 is capable for bearing.

Formula (1) P=F/A represents that relationship of Pressure, Force and Area. In the present invention, the first end 221 of the outer cylinder 22 is coupled to the base 10, and the pedal member 12 is adapted for being stepped on by users so that the base 10 bears a downward force. Because the first end 221 of the outer cylinder 22 has the larger cross-sectional area than the other portions of the outer cylinder 22, the force that the first end 221 of the outer cylinder 22 has to bear is smaller than the other portions of the outer cylinder 22. Therefore, the structure of the first end 221 of the outer cylinder 22 is much stronger.

Formula (2) (bending stress)=(bending moment)*(article radius)/(area moment of inertia) represents that in the present invention and because the first end 221 of the outer cylinder 22 has the larger radius of cross-sectional area than the other portions of the outer cylinder 22, the bending stress that the first end 221 of the outer cylinder 22 can bear is larger than the other portions of the outer cylinder 22. Therefore, the structure of the first end 221 of the outer cylinder 22 is much stronger and the floor pump will not break easily during long periods of use.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A floor pump comprising:

a base;

a cylinder assembly including an outer cylinder having a first end and a second end and an inner cylinder disposed in the outer cylinder and having a first end and a second end, with a cross-sectional area of the first end of the outer cylinder being larger than the first end of the outer cylinder; wherein the second end of the outer cylinder is coupled onto the base means;

wherein the first end of the inner cylinder is coupled onto the base;

a linkage assembly partially disposed in the inner cylinder and communicating with the base, with the linkage assembly including a piston reciprocatingly driven to move in the inner cylinder; and a hose having a first end coupled to the base and communicating with the linkage assembly, and a second end configured to be coupled to a thing desired to be inflated.

2. The floor pump as claimed in claim 1, wherein the base includes a coupled member and a pedal member, with the coupled member integrally protruding from the pedal member, with the pedal member expanding from two sides of the coupled member, and with the linkage assembly and the hose both coupled to the coupled member.

3. The floor pump as claimed in claim 2, wherein the coupled member includes a first connective portion coupled on the pedal member and coupled to the outer cylinder, a second connective portion coupled to the inner cylinder and a third connective portion coupled to the hose.

4. The floor pump as claimed in claim 3, with the first connective portion being an annular groove, with the second connective portion surrounded by the first connective portion, and with horizontal positions of the first and second connective portions being different.

5. The floor pump as claimed in claim 4, further comprising a receptacle formed on the second connective portion and a valve element engaged with the first end of the inner cylinder and disposed in the receptacle.

6. The floor pump as claimed in claim 5, further comprising two engaged holes longitudinally defined at the coupled member and communicating the first and second connective portions with each other and two fixed holes formed on the valve element and corresponding to the engaged holes; wherein the engaged holes engage with the fixed holes via two fasteners to attach the inner cylinder to the base.

7. The floor pump as claimed in claim 1, further comprising a cap element mounted on the second end of the outer cylinder and coupled to the second end of the inner cylinder, with the cap element including two hook portions extending from two sides thereof for clamping the hose in position selectively.

8. The floor pump as claimed in claim 7, wherein the linkage assembly further includes a linkage that has a first end and a second end, a handle installed on the second end of the linkage, with the piston coupled to the first end of the linkage; wherein the linkage is inserted through the inner cylinder to the through-hole of the cap element, and wherein the piston is reciprocatingly driven to move in the inner cylinder by operation of the handle, with the handle exposed from the cap element.

9. The floor pump as claimed in claim 1, wherein the outer cylinder has a constant wall thickness, and wherein a diameter of the outer cylinder is tapered off to the second end from the first end, with the outer cylinder being shaped as an awl.

* * * * *